US007871312B2

(12) United States Patent
Wirkkala

(10) Patent No.: US 7,871,312 B2
(45) Date of Patent: Jan. 18, 2011

(54) HYDRANT GRINDING ARRANGEMENT

(76) Inventor: Matthew T. Wirkkala, 47 Lawrence Rd., Boxford, MA (US) 01921

( * ) Notice: Subject to any disclaimer, the term of this patent is extended or adjusted under 35 U.S.C. 154(b) by 709 days.

(21) Appl. No.: 11/980,246

(22) Filed: Oct. 30, 2007

(65) Prior Publication Data

US 2009/0106965 A1 Apr. 30, 2009

(51) Int. Cl.
*B24B 19/00* (2006.01)

(52) U.S. Cl. ..... 451/430; 451/211

(58) Field of Classification Search ..... 451/51, 451/211, 430

See application file for complete search history.

(56) References Cited

U.S. PATENT DOCUMENTS 2,416,247 A * 2/1947 Wilcox ..... 451/430
2,460,985 A * 2/1949 Jackson ..... 451/430
4,287,688 A * 9/1981 Jensen ..... 451/430
4,715,149 A * 12/1987 Kelsey ..... 451/430
5,030,046 A * 7/1991 Ricci ..... 451/430
5,099,565 A * 3/1992 Campbell ..... 29/402.08
5,697,834 A * 12/1997 Heumann et al. ..... 451/440
5,897,429 A * 4/1999 Durovchic ..... 451/430
5,931,728 A * 8/1999 Larsson ..... 451/430

* cited by examiner

*Primary Examiner*—Maurina Rachuba
(74) *Attorney, Agent, or Firm*—Don Halgren

(57) ABSTRACT

An adjustable removable grinding arrangement for grinding inside annular openings in bottom portions of water hydrants. The grinding arrangement comprises a router having an energizable motor with a grinding tool attached to an end thereof, a base plate supportively attached to an end of a housing of the router, a support plate pivotally attached to the base plate attached to the router, and an annular guide ring having securement studs for removable securement to a rim of an opening on a lower end of a hydrant. The support plate is rotatable on a plurality of wheel members engaged with the guide ring to permit the grinding tool of the router to remove material from the rim of the hydrant as the support plate is rotated about the guide ring.

6 Claims, 5 Drawing Sheets

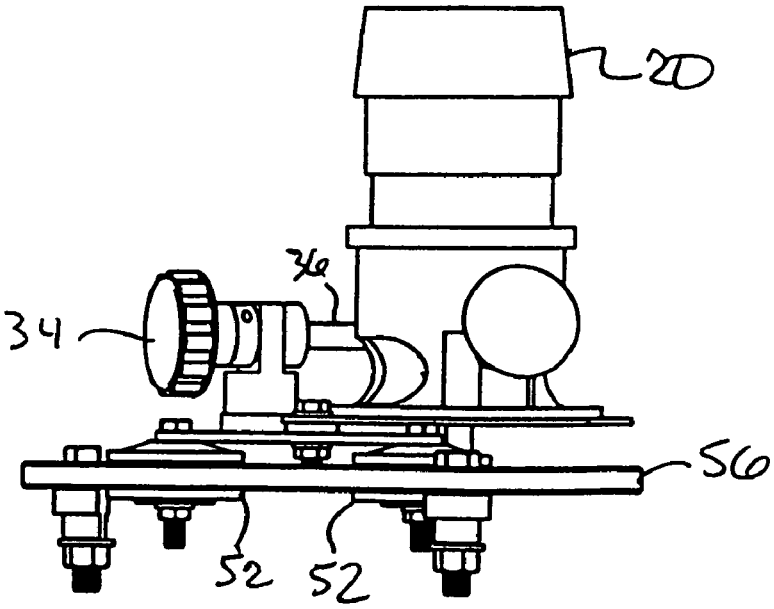
FIG5
FIG4
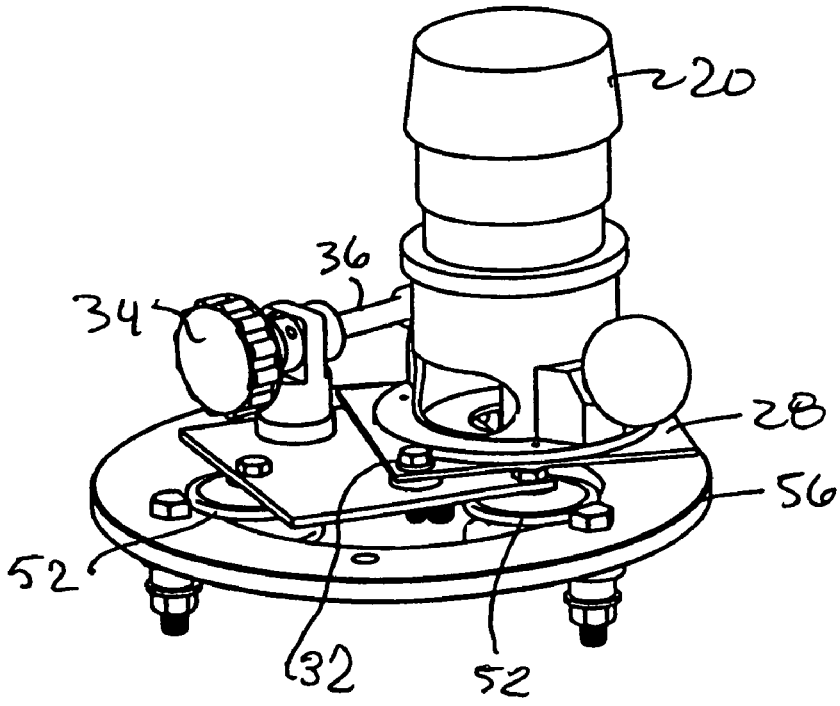

HYDRANT GRINDING ARRANGEMENT

BACKGROUND OF THE INVENTION

1. Field of the Invention

This invention relates to grinding devices and more particularly to adaptors for grinders for the fitting of new, different inside diameter water main receiving-openings of fire hydrants to existing piping and water main systems.

2. Prior Art

Replacement of aging fire hydrants is commonplace in about every community throughout the country. The fire hydrant itself is a valving device which is connected to a buried water main. Such water mains are typically made from cast iron and are expensive to replace, and often lasting many more years than any hydrant which it serves. Those mains are typically buried relatively deeply in the ground, to prevent them from freezing. These mains may have a pipe extending to the ground surface with a valve below the frost line. Most hydrants are connected to a main, by a six inch pipe. However, a proper mating between the hydrant and the main is frequently time consuming and expensive to facilitate. Often, the municipality will cut a nipple out of ductle iron in order to fit it to the hydrant. Thereafter they may install a repair sleeve which must be tied back using threaded rods, eye bolts and locking gland.

It is an object of the present invention to overcome the disadvantages of the prior art.

It is a further object of the present invention to provide a jig arrangement which is attachable to hydrants, gates, and offsets to permit the grinding off of an inner circumference of hydrant material so as to permit a proper fit with the outer circumferential ring of the pre-existing water main to which it should mate.

It is still yet a further object of the present invention to permit the use of newer hydrants with the existing older water main which may be readily and inexpensively relined, compared to the cost of replacing them by the mere adaptation of those old lines to the proper enlargable inner opening sizing of the newer hydrants.

BRIEF SUMMARY OF THE PRESENT INVENTION

The present invention comprises an adjustable jig for grinding or milling the inside lip of the lower open end of a fire hydrant. The grinding or router apparatus is attached to the adjustable jig. The grinder comprises a router having a motor and a grind tool powered thereby. The router has a lower end which is secured to a base plate of the jig. The base plate is attached to a generally rectangularly shaped support plate by a pivot stud arranged therebetween.

An adjustable knob has a router link extending therefrom supported in a support brace. The router link has a distal end which is threadedly disposed through a link-bearing secured to the router housing. Rotation of the adjustable knob causes the threaded router link to turn through the link bearing which itself is threaded, to effect rotational or pivotal movement of the base plate with respect to the support plate. The support plate has three studs extending therethrough, located at the apexes of an imaginary triangle on that support plate. The studs extending through the support plate each act as axis for a guide support wheel. Each of the three guide support wheels are in rotational engagement with an inner race of an annular guide ring. The annular guide ring has three annularly spaced apart studs extending therethrough. Each stud has a lower distal end with a flange receiver thereon.

Each flange receiver has a flat side in the annular shoulder which mates with an annular flange on the outer diameter of the lip on the lower end of the hydrant being milled.

The router is energizable so as to turn the grinding tool, and the adjustment knob is rotated so as to effectuate adjustment of the base plate with respect to the support plate so as to cause the grind tool to mill an inside diameter of the lip at the lower end of the hydrant. Rotation of the support plate with respect to the annular guide ring effects circumferential motion of the grind tool along the inner periphery of the inside of the lip at the lower end of the hydrant.

Milling or grinding of the inside diameter at the lower end of the hydrant, so as to accommodate a (typically larger) outer diameter of the existing water main, to permit its snug receipt thereof with minimal effort and expense when an old hydrant is being replaced by a new hydrant where mating male and female relationships may be readily accommodated.

The invention thus comprises a method of repairing a municipal water supply delivery source without requiring replacement of an associated water main delivery main, comprising: one or more of the following steps comprising: removing an existing water hydrant from the water system delivery main; grinding an enlarged inner annular rim by attaching a removable adjustable grinding arrangement onto a replacement water hydrant; removing the removable grinding arrangement from the replacement hydrant; and mating the inner annular rim of the replacement hydrant onto the associated water delivery main. The method also includes the steps of: attaching a guide ring of an adjustable removable grinding arrangement to a flange on a lower end of the hydrant; energyzing the grinding arrangement; rotating the grinding arrangement around the guide ring so as to engage a grind tool against the inner annular rim of replacement hydrant, to enlarge the rim to mate with the water main.

The invention also comprises an adjustable removable grinding arrangement for grinding inside annular openings in bottom portions of water hydrants, comprising: a router having an energizable motor with a grinding tool attached to an end thereof; a base plate supportively attached to an end of a housing of the router; a support plate pivotally attached to said base plate attached to the router; an annular guide ring having securement studs for removable securement to a rim of an opening on a lower end of a hydrant, said support plate being rotatable on a plurality of wheel members engaged with the guide ring to permit the grinding tool of the router to remove material from the inner edge of the rim of said hydrant as the support plate is rotated about the guide ring. The support plate preferably has an adjustment knob which has a connective arrangement between the support plate and the base plate to enable the base plate and the router thereattached to be adjusted radially with respect to the guide ring. The connective arrangement comprises a threaded router link maintained between a support brace on the support plate and a link bearing attached to the base plate and a housing portion of the router. The support plate preferably has a plurality of revolvable guide support wheels thereon which run on an annular race on an inner annular surface of the guide ring to permit the router to swing thereabout. The guide ring preferably has a plurality of studs thereon, each of the studs having a hydrant flange receiver thereon for securement of the guide ring and the router to a flanged open end of a hydrant to be milled. The base plate has a single router pivot axis in engagement with the support plate to permit the base plate and the router thereon to pivot with respect to the support plate when the adjustment knob is rotated.

BRIEF DESCRIPTION OF THE DRAWINGS

The objects and advantages of the present invention will become more apparent, when viewed in conjunction with the following drawings in which:

FIG. 5 is a side elevational view from a different angle, of the guide apparatus shown in FIG. 2; and FIG. 6 is a perspective view of the guide ring and router from a lower angle thereof.

DETAILED DESCRIPTION OF THE PREFERRED EMBODIMENTS

Figure 1:
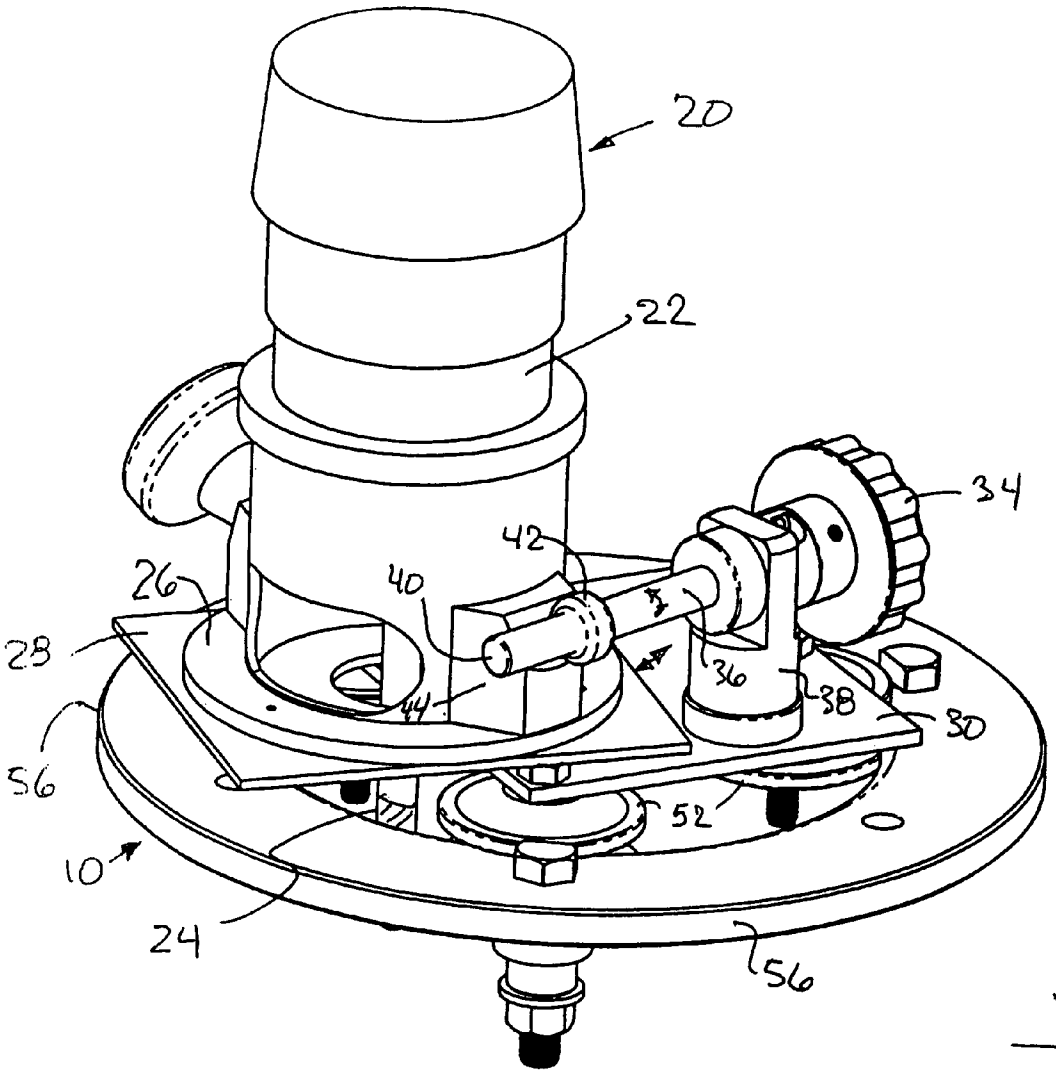
FIG. 1 is a perspective view of a router and guide arrangement which is utilized to adjustably grind the inner diameter of the lower end of an opening on a fire hydrant.
Figure 1A:
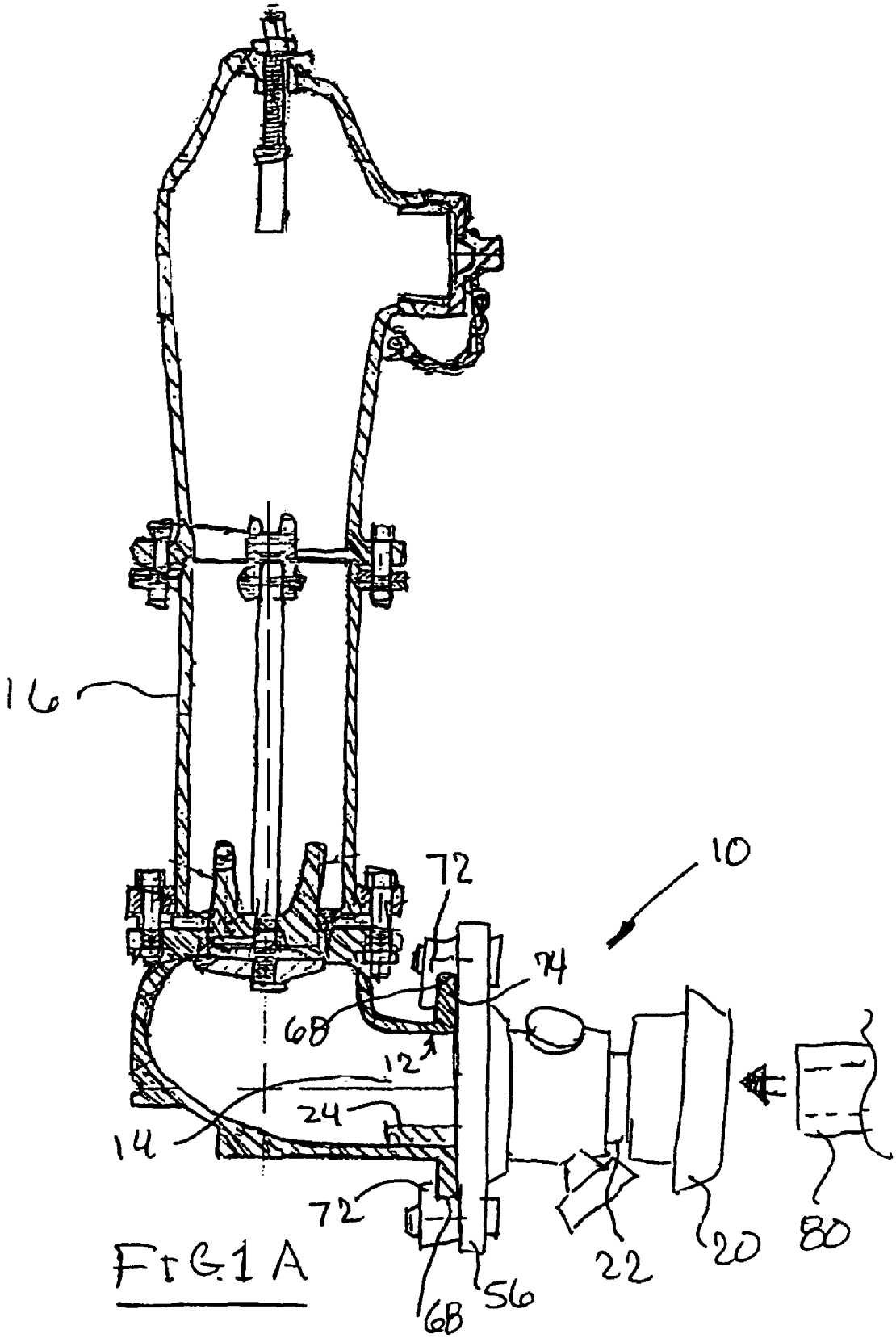
FIG. 1A is a side elevational view, partly in section, of a hydrant having a router and guide apparatus secured, for milling purposes, to a lower end thereof.
Figure 2:
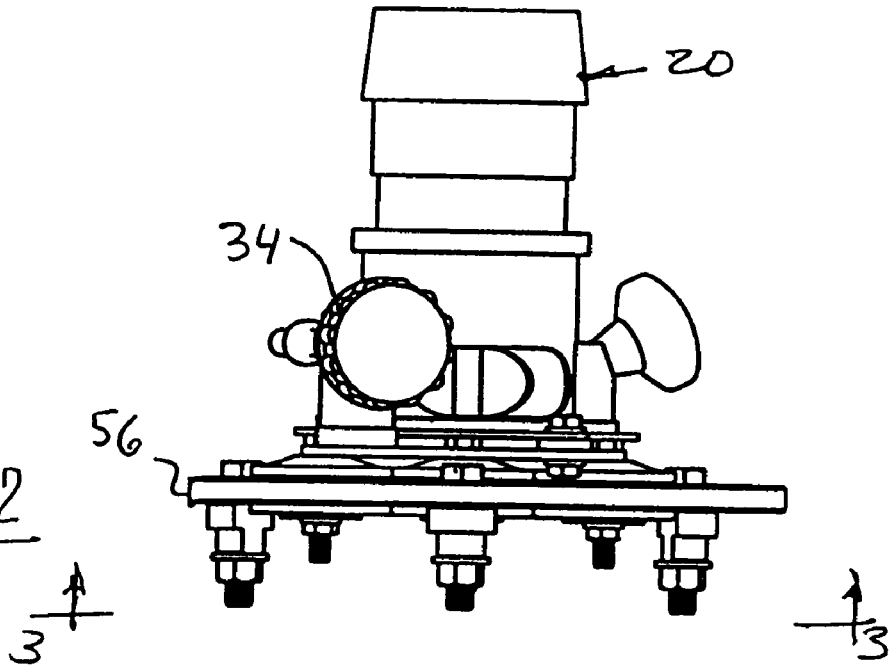
FIG. 2 is a side elevational view of the router and guide apparatus shown in FIG. 1.
Figure 3:
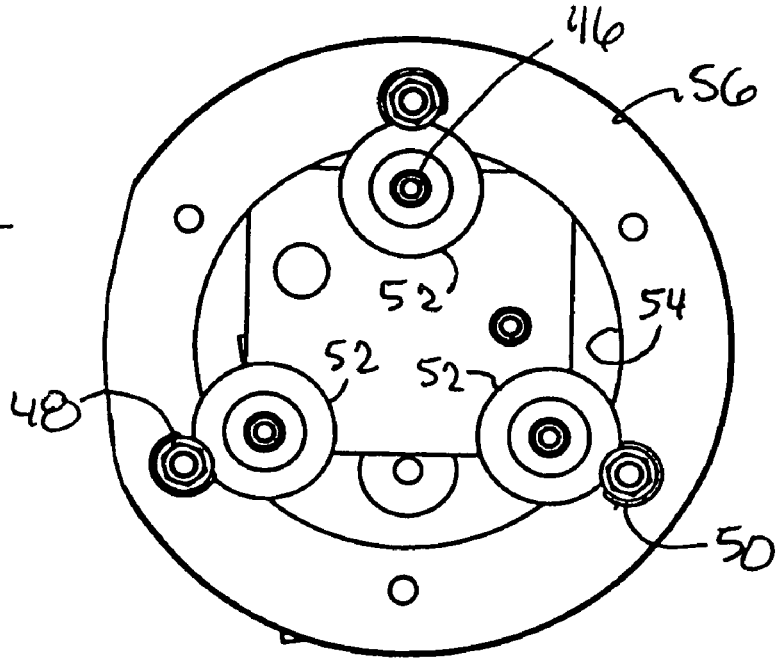
FIG. 3 is a view taken along the lines 3-3 of FIG. 2.
Figure 4:
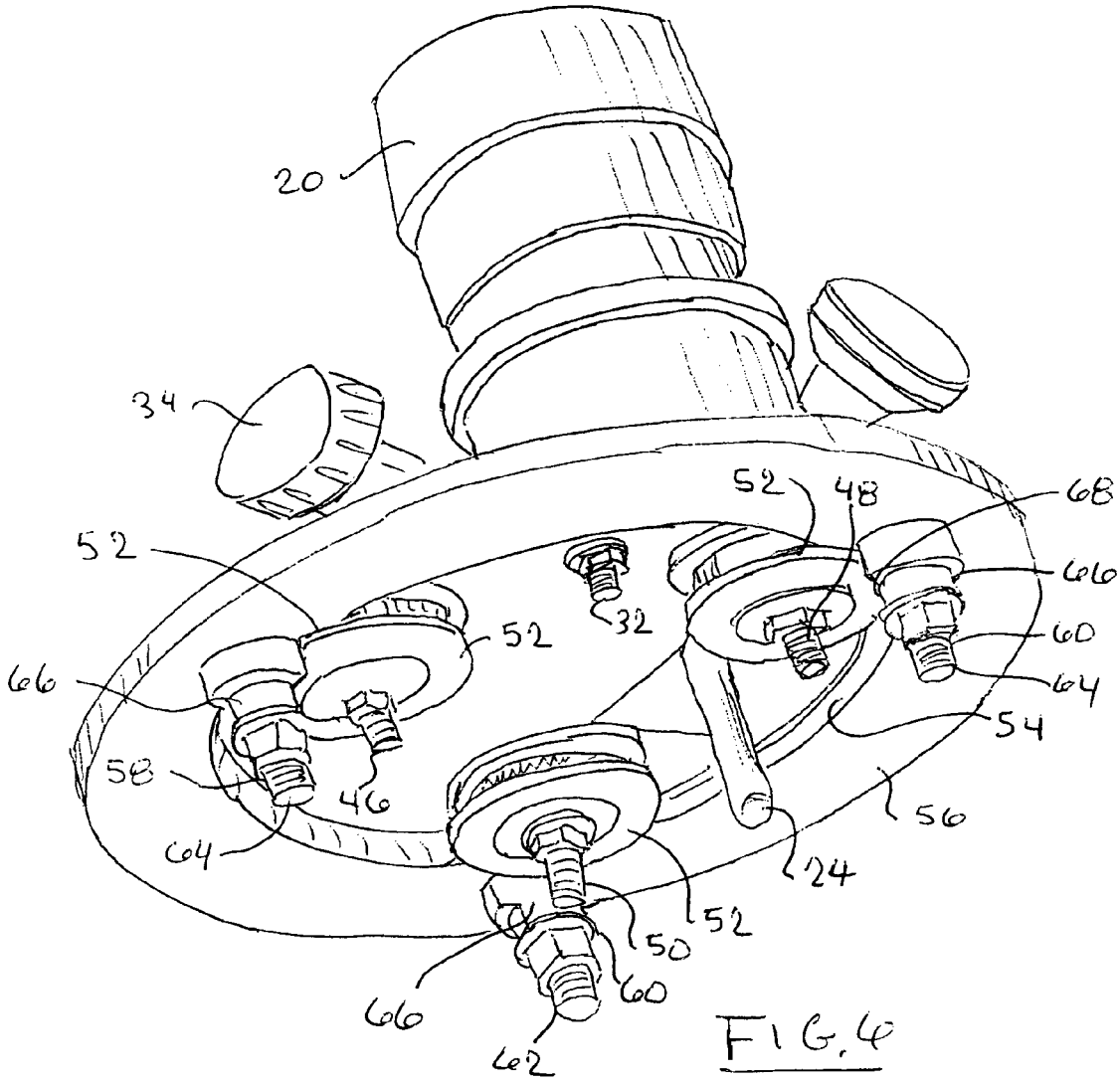
FIG. 4 is a further perspective view of the guide apparatus shown in FIG. 1.

Referring now to the drawings in detail and particularly to FIG. 1, there is shown the present invention which comprises an adjustable jig 10 for grinding or milling the inside lip 12 of the lower open end 14 of a fire hydrant 16, as represented for example, in FIG. 1A. A grinding or router apparatus 20 is attached to the adjustable jig 10, as represented in FIGS. 1, 1A, 2, 3, 4, 5 and 6. The grinder/router 20 having an empowerable motor 22 and an attached milling/grinding tool 24 powered thereby. The router 20 has a lower end 26 which is secured to a base plate 28 of the jig 10. The base plate 28 is pivotally attached to a generally rectangularly shaped support plate 30 by a pivot stud 32 arranged therebetween.

An adjustable knob 34, best represented in FIG. 1, has a router link 36 extending therefrom rotatably supported in a support brace 38. The router link 36 has a distal end 40 which is threadedly disposed through a link-bearing 42 secured to the router housing 44. Rotation of the adjustable knob 34 causes the threaded router link 36 to turns through the link bearing 42 which itself is threaded, to effect rotational or pivotal movement of the base plate 28 with respect to the support plate 30. The support plate 30 has three studs 46, 48 and 50, best represented in FIGS. 3 and 6, extending therethrough, located at the apexes of an imaginary triangle on that support plate 30. The studs 46, 48 and 50 extending through the support plate 30 each act as axis for a guide support wheel 52. Each of the three guide support wheels 52 are in rotational engagement with an inner race 54 of an annular guide ring 56, as is represented in FIG. 6.

The annular guide ring 56 has three annularly spaced apart studs 58, 60 and 62 extending therethrough. Each stud 58, 60 and 62 has a lower distal end 64 with a flange receiver 66 thereon, as is represented in FIG. 6.

Each flange receiver 66 has a flat side 68 in its annular shoulder 70 which mates with an annular flange 72 on the outer circumference of the lip 74 on the lower end of the hydrant 16, being milled, as represented in FIG. 1A.

The router 20 is energizable so as to turn the grinding tool 24, and the adjustment knob 34 is rotated so as to effectuate adjustment of the base plate 28 with respect to the support plate 30 so as to cause the grind tool 24 to mill an inside circumferential cut against the lip 78 at the lower open end 14 of the hydrant 16. Rotation of the support plate 30 with respect to the annular guide ring 56 effects circumferential motion of the grind tool 24 along the inner periphery of the inside of the lip 78 at the lower open end 14 of the hydrant 16.

Milling or grinding of the inside diameter at the lower open end 14 of the hydrant 16, so as to accommodate a (typically larger) outside diameter of the existing water main 80, represented in FIG. 1A, to permit its snug receipt thereof with minimal effort and expense when an old hydrant is being replaced by a new hydrant where mating male and female relationships may be readily accommodated.

I claim:

1. An adjustable removable grinding arrangement for grinding inside annular openings in bottom portions of water hydrants, comprising:

a router having an energizable motor with a grinding tool attached to an end thereof;

a base plate supportively attached to an end of a housing of said router;

a support plate pivotally attached to said base plate attached to said router;

an annular guide ring having securement studs for removable securement to a rim of an opening on a lower end of a hydrant, said support plate being rotatable on a plurality of wheel members engaged with said guide ring to permit said grinding tool of said router to remove material from an inner edge of said rim of said hydrant as said support plate is rotated about said guide ring.

2. The grinding arrangement as recited in claim 1, wherein said support plate has an adjustment knob has a connective arrangement between said support plate and said base plate to enable said base plate and said router thereattached to be adjusted radially with respect to guide ring.

3. The grinding arrangement as recited in claim 2, wherein said connective arrangement comprises a threaded router link maintained between a support brace on said support plate and a link bearing attached to said base plate and a housing portion of said router.

4. The grinding arrangement as recited in claim 2, wherein said support plate has a plurality of revolvable guide support wheels thereon which run an annular race on an inner annular surface of said guide ring to permit said router to swing thereabout.

5. The grinding arrangement as recited in claim 2, wherein said guide ring has a plurality of studs thereon, each of said studs having a hydrant flange receiver thereon for securement of said guide ring and said router to a flanged open end of a hydrant to be milled.

6. The grinding arrangement as recited in claim 3, wherein said base plate has a single router pivot axis in engagement with said support plate to permit said base plate and said router thereon to pivot with respect to said support plate when said adjustment knob is rotated.

* * * * *